United States Patent [19]

Friz

[11] 4,129,803

[45] Dec. 12, 1978

[54] TRAVELING WAVE DEVICE WITH CAST SLOW WAVE INTERACTION STRUCTURE AND METHOD FOR FORMING

[75] Inventor: Walter Friz, Yellow Springs, Ohio

[73] Assignee: Louis E. Hay, Dayton, Ohio

[21] Appl. No.: 784,806

[22] Filed: Apr. 5, 1977

[51] Int. Cl.[2] ..... H01J 25/34

[52] U.S. Cl. ..... 315/3.5; 29/600; 315/3.6; 428/586; 428/596

[58] Field of Search ..... 315/3.5, 3.6, 5.35, 315/39.73; 29/600, DIG. 5, DIG. 10, 33 C, 180 CH, 180 CJ

[56] References Cited

U.S. PATENT DOCUMENTS

| | | | |
|---|---|---|---|
| 2,881,348 | 4/1959 | Palluel | 315/39.73 X |
| 2,925,515 | 2/1960 | Peter | 315/3.5 |
| 3,327,371 | 6/1967 | Kerns et al. | 29/600 |
| 3,443,146 | 5/1969 | Buck | 315/39.73 X |
| 3,514,662 | 5/1970 | Eldredge | 315/3.5 |
| 4,013,917 | 3/1977 | Horigome et al. | 315/3.5 |

*Primary Examiner*—Saxfield Chatmon, Jr.

[57] ABSTRACT

A traveling wave device having a slow wave structure formed from at least one casting in which at least a portion of the internal passages are formed during the casting process to provide a more rigid structure having improved dimensional retention through the elimination of a multiplicity of brazed joints at and between adjacent cavity walls.

8 Claims, 14 Drawing Figures

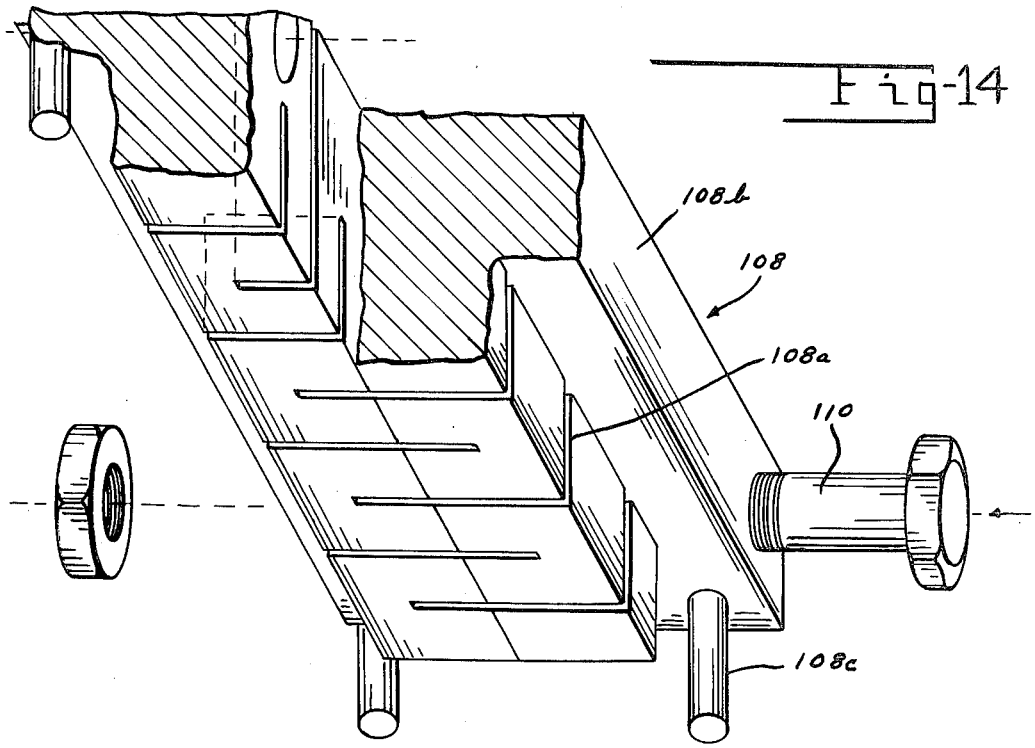
Fig-14
Fig-13
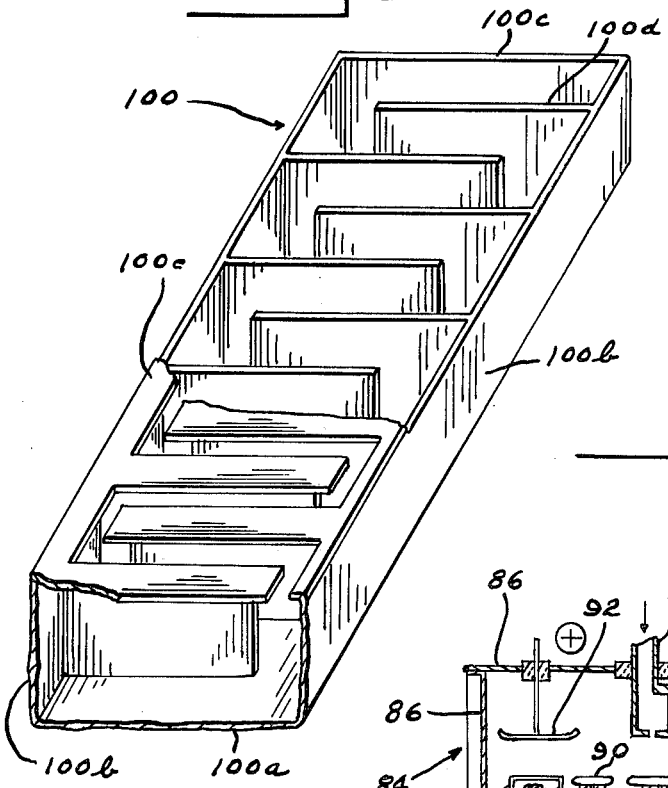
Fig-12
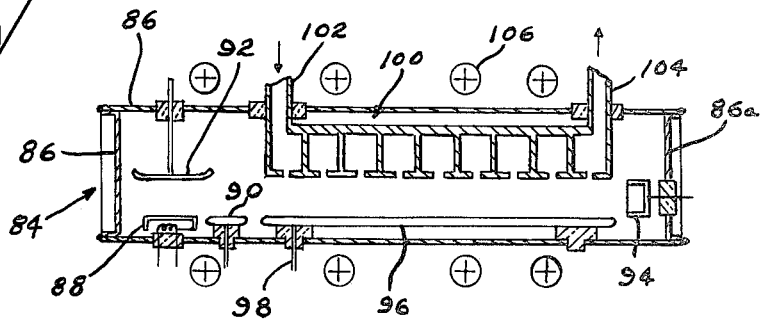

TRAVELING WAVE DEVICE WITH CAST SLOW WAVE INTERACTION STRUCTURE AND METHOD FOR FORMING

REFERENCE TO RELATED APPLICATIONS

Application Ser. No. 757,698 filed Jan. 7, 1977 relating to traveling wave devices having composite metal dielectric slow wave structures.

BACKGROUND OF THE INVENTION

Coupled cavity type circuits have wide application as interaction circuits in high power traveling wave tubes. They are distinguished by high thermal dissipation capabilities since they are all-metallic and propogate only waveguide modes. Their technology is well established in the art, and they are suitable for economical production in applications up to 20GHz.

Current practice has been to manufacture circuits for the higher frequencies with the same technology used to manufacture circuits for the lower frequencies. This practice results in a highly unsatisfactory dimensional integrity and also in a high scrap factor; the combination of which results in lower efficiency of operation and higher costs of production and operation.

Several manufacturing problems have existed because of the necessity for maintaining very stringent fabrication tolerances during the high temperature brazing of a cavity stack having up to 100 transverse braze joints.

SUMMARY OF THE INVENTION

In accordance with the teachings of the present invention, a first form of the slow wave structure is manufactured without a braze joint, and a second and third form of slow wave structure requires only several relatively simple brazed joints which in all cases are flat junctions. This results in the near elimination of the multiple brazing operations which were the greatest single problem in the prior fabrication of such devices because of a multiplicity of minute and discrete components, each of which had to be brazed to its adjacent components.

In the first form depicted in FIGS. 1–4 and used in O type traveling wave devices, this is accomplished by forming a disposable core around which the slow wave structure is vacuum cast of oxygen free high conductivity copper which is commonly referred to as OFHC copper. After being cast, the rough slow wave structure is finish machined on the outside and the disposable core is removed by chemical etching. If desired, the core may be removed before the machining operations have been completed. It is noted that this manufacturing technique does not require any internal machinging operations, that there are no brazing operations, and that optimum rigidity is attained. There is also metal continuity without any joints.

In the second form depicted by FIGS. 8 through 11, the electron beam passage is cast around a disposable core and the individual cavity walls are machined into two castings which were vacuum cast from OFHC copper, and which are then assembled in face-to-face relationship with the cavity walls in one casting interdigitating with the cavity walls of the second casting, and with the electron beam passages in one casting being on a common longitudinal axis with the electron beam passages in the second casting. The slow wave structure is completed into an integral assembly by brazing two flat side wall members to the machined castings to form a "box-like" structure. As will be shown in FIGS. 10 and 11, and will be further described below, the cross-section of the slow wave structure may be square, rectangular or round. As will also be described, only four braze joints are required, and these are simple joints. Since the cavity walls are machined into castings instead of being formed by prior methods such as forming them individually or folding them from very thin sheet metal, very close manufacturing tolerances and dimensional integrity are maintained.

A third form depicted in FIGS. 12 through 14, relates to an interacting slow wave structure now known in the art as a split folded wave guide and used in M type traveling wave devices. In the two prior forms of slow wave structures which have been described above, the electron beam passes through the slow wave structure; however, in the third form the electron beam passes on the outside and interacts with RF energy flowing along the meander line within the structure through splits in the outer cavity wall of the slow wave structure adjacent to the electron beam. This type of slow wave structure was named a split folded wave guide because of the splits in one outer cavity wall and because the path taken by the wave guide is folded back and forth. As will be shown, within the embodiment of the invention, three of the outer cavity walls and all inner cavity walls will be formed of an integral casting, thus requiring only the brazing thereto of the split outer cavity wall. This construction will greatly increase the structural strength and dimensional stability over the prior art.

Since the theory of traveling wave devices and their components are well covered in the published art, a further discussion is not deemed necessary for a full understanding of the present invention. Some excellent references on the subject are: Traveling Wave Tubes J. R. Pierce, and Micro Wave Electonics by John C. Slater, both of which are published by D. Van Nostrand Company; and Power Traveling Wave Tubes by J. F. Gittins which is published by American Elsevier Publishing Company.

BRIEF DESCRIPTION OF THE DRAWINGS

FIG. 12 is a cross-sectional view of a typical traveling wave device incorporating a slow wave structure of the type called a split folded wave guide;

FIG. 13 is a perspective of the slow wave structure depicted in cross-section in FIG. 12 and made in accordance with the present invention; and, FIG. 14 is a perspective of the disposable core used in casting the cast portion of the structure shown in FIG. 13.

DESCRIPTION OF THE PREFERRED EMBODIMENT

Figure 1:
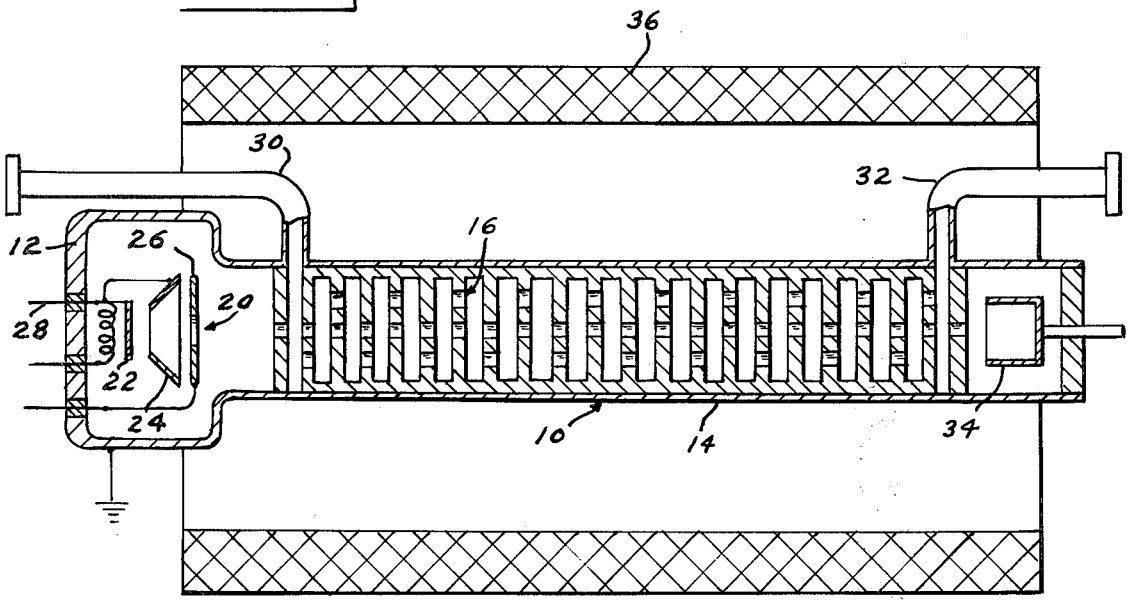
FIG. 1 is a cross-sectional view of a typical traveling wave device utilizing a slow wave structure in accordance with the present invention.

Referring to FIG. 1 which incorporates the embodiment of the invention, the traveling wave device 10 has an elongated metallic body member 12 having a longitudinal tubular body element 14. Supported within the longitudinal tubular element in fixed relationship is a slow wave structure 16 which will be described in greater detail below.

Many slow wave structures are extremely delicate and fragile, and for these reasons must be supported and protected from without. The usual method is to support and protect them within a portion of the structurally rigid body member. Other slow wave structures can be built with much heavier and structurally rigid outer walls having sufficient strength and dimensional stability that the outer walls may be made to constitute a portion of the body. Such heavy walled slow wave structures, other requirements permitting, need not be housed within the body member, but may constitute a portion of the body member itself. In such cases, the usual practice is to braze or otherwise join the two opposing ends of the body to the ends of the slow wave structure. For purposes of the present invention, a slow wave structure will be considered to be within a body member when it is actually within a body member as shown in FIG. 1; or, when the outer walls of the slow wave structure are of sufficient thickness and rigidity to protect the delicate cavity walls and keep them in alignment, in which case the slow wave structure will be deemed to be within the body member. In other words, the slow wave structure is built integral with the body member.

Housed and supported within one end of the body member 12 is a conventional electron gun 20 having a cathode 22, a focusing electrode 24 and an accelerating anode 26. Suitable DC is applied through leads 28. The electron gun is positioned to project its electron beam output coaxial with the longitudinal axis of the slow wave structure 16. As depicted, the electron gun is longitudinally displaced from the first end of slow wave structure 16. As further depicted, the portion of body member 12 which houses the electron gun 20 is of larger diameter than the portion of the body member housing the slow wave structure. This is not a requirement except in situations where the envelope of the electron gun is of diameter larger than that of the slow wave structure.

RF energy is coupled to the slow wave structure as depicted by means of input line 30 and output line 32. Such lines are well known to the art and need not be further described.

A collector 34 is housed and dielectrically supported within body member 12. The collector is longitudinally displaced from the second end of slow wave structure 16 and is preferably coaxial with the slow wave structure and the electron gun. The collector collects and dissipates the electrons spent from the second end of the slow wave structure in a manner well known to the art.

The body member 12 is encompassed by an electromagnetic means 36 which is coaxial with the electron beam being propagated on the axis of the slow wave structure 16. The purpose of the electromagnetic means is to prevent beam spread and deviation.

Figure 2:
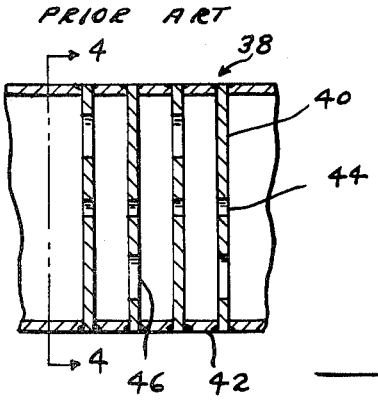
FIG. 2 is a cross-sectional view of a portion of a typical slow wave structure fabricated in accordance with the prior art.

Specific reference is now made to FIG. 2 which is a longitudinal cross-section of a portion of a typical slow wave structure 38 fabricated in accordance with the prior art. This structure comprises a plurality of wafers 40 which are held in spaced longitudinal relationship by a plurality of rings 42 having the same outside diameter as the wafers. As indicated, each end of each ring is continuously brazed to the adjacent wafer. The internally contained volume formed between two adjacent wafers and the ring separating them is referred to as a cavity, with the ring forming the outer cavity wall and the wafers forming the inner cavity walls. Each wafer has an electron beam passage 44 and an RF passage 46. As depicted, the electron beam passages 44 are all on a common longitudinal axis, whereas the RF passages 46 in adjacent wafers are staggered to be 180° apart. In operation, the electron beam passes through the slow wave structure in a straight line, whereas the RF energy passes through adjacent inner cavity walls on a meander line.

Slow wave structures made in accordance with the prior art are extremely difficult and expensive to build. There may well be on the order of 50 wafers and 50 rings requiring on the order of 100 brazed joints continuously around the perimeter of the structure. Since the components are all normally made of very thin copper, the difficulty in performing the brazing operations and maintaining dimensional integrity is readily understood. All tolerances are extremely critical, and any deviation from these tolerances, or a single defective brazed junction will result in scrap. The scrap factor on slow wave structures built to date by this method has been unsatisfactory.

Figure 3:
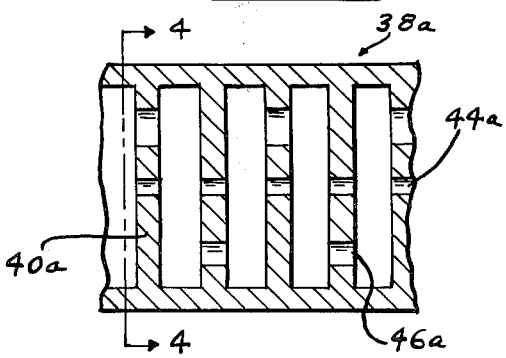
FIG. 3 is a cross-sectional view of a portion of a typical slow wave structure fabricated in accordance with the present invention.

Specific reference is now made to FIG. 3 which is comparable to FIG. 2 and depicts the slow wave structure made in accordance with the teachings of the present invention. The entire structure is made of a casting without braze joints; i.e., the configuration of 38*a* is comparable to 38 in FIG. 2 except for being without braze joints. In like manner, electron beam passages 44*a* and RF passages 46*a* of FIG. 3 are comparable to 44 and 46 in FIG. 2.

Figure 4:
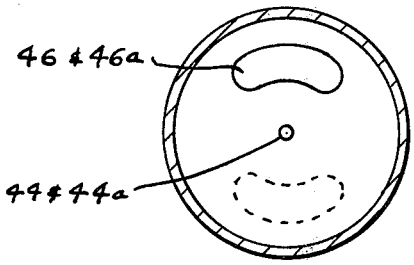
FIG. 4 is a cross-sectional view along section 4—4 of both FIG. 2 and FIG. 3 showing identical passages through the inner cavity walls.

FIG. 4 is common to both the construction depicted in FIG. 2 and the new construction depicted in FIG. 3.

Figure 5:
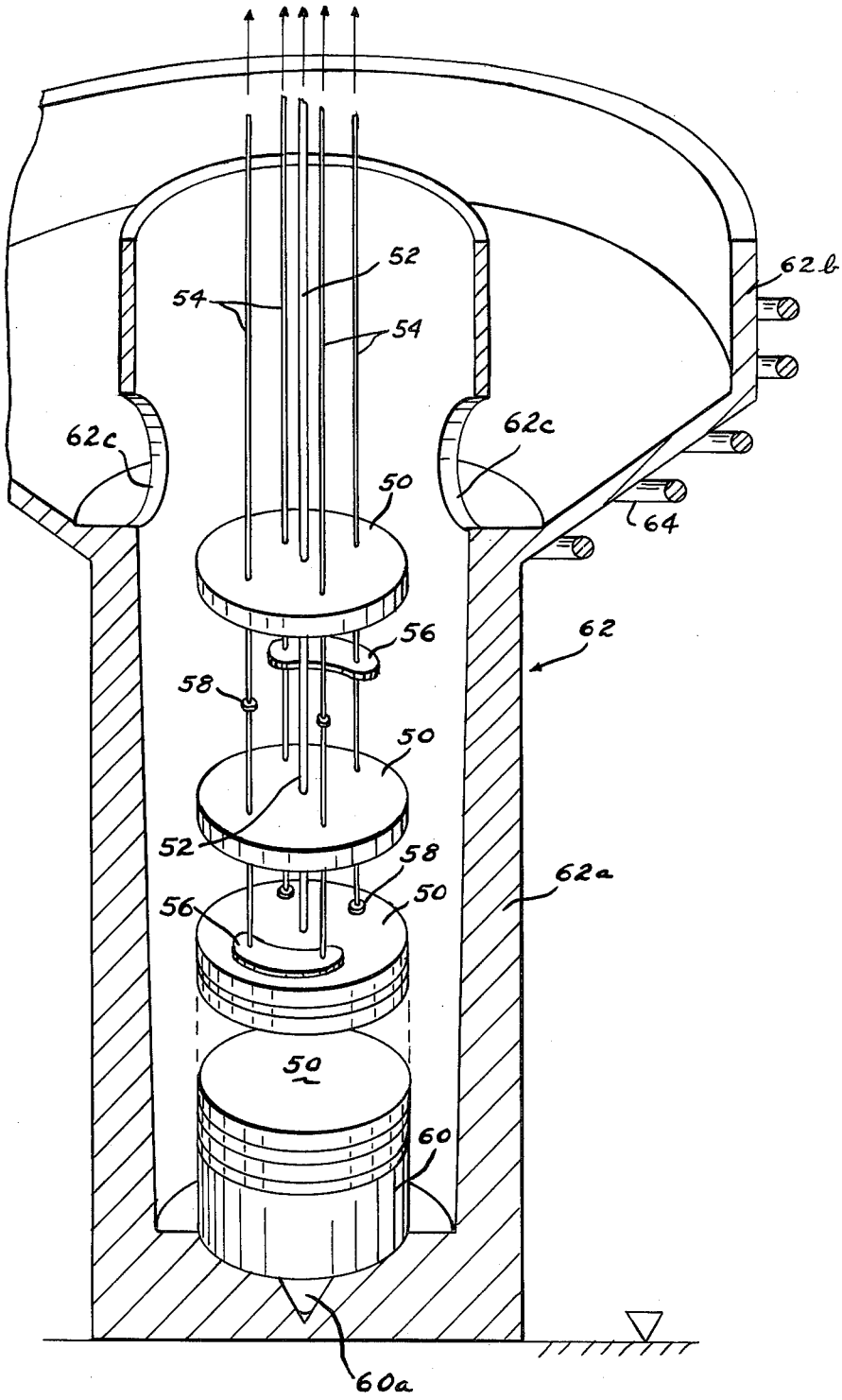
FIG. 5 is an enlarged cross-sectional elevation of the apparatus in which one form of slow wave structure is cast, and further showing in perspective the assembly of the core elements and their vertically suspended alignment within the mold portion of the apparatus.

Specific reference is now made to FIG. 5 which illustratively depicts the manner of constructing the core, and the apparatus for casting the slow wave structure 16 in accordance with the teachings of the present invention. The slow wave structure is vacuum cast of oxygen free high conductivity copper which is commonly referred to as OFHC copper.

The core assembly may be said to be a built-up core in which the discrete components are strung on vertical wires which hold them in proper spaced relationship with each other. As illustrated, the inner cavity walls 40*a* of FIG. 3 are cast between two adjacent core wafers 50 depicted in FIG. 5. The core wafers 50 are strung on a plurality of wires, comprising a central core wire 52 which forms the electron beam passages 44*a* shown in FIG. 3, and a plurality of guide wires 54 whose purpose will be further explained below.

The RF passages 46*a* shown on FIG. 3 and FIG. 4 are formed with passage cores 56 strung on two adjacent guide wires 54 in a staggered manner as illustrated in order to provide staggered passages in adjacent inner cavity walls of the slow wave structure to be cast. Very small support washers 58 are strung on two guide wires 54 to be opposite to the passage cores 56. All passage cores 56 and support washers are made of a suitable material having the same thickness as the inner cavity walls 40*a* as shown in FIG. 3. This will provide open passages through the cavity walls.

The lower ends of the central core wire 52 and the guide wires 54 are joined to a metallic end plug 60 by any of several methods which are well known to the metal arts. The lower end of end plug 60 terminates in a tapered male centering tip 60*a* for use in subsequent machining operations. After the final core wafer 50 has been strung onto the wires, a second end plug, which may be identical to end plug 60 except for holes which are necessary for passage of the wires, is strung onto the wires with the centering tip 60*a* outward to point in the opposite direction to the lower end plug.

The apparatus in which the slow wave structure is to be cast comprises a vertical mold 62 having an elongated portion 62*a* which is open at the upper end and which has a closed lower end having a tapered cavity for engaging the centering tip 60*a* on end plug 60. The interior cavity within the elongated portion is configured to the rough outer desired configuration of the cast slow wave structure and is made with a draft angle sufficient for removal of the cast slow wave structure after it has cooled. The outer closed end is accurately machined to be perpendicular to the longitudinal axis of the interior cavity for reasons which will be explained below. The upper end of the elongated portion of the mold is surrounded by a hopper 62*b* having passages 62*c* which communicate with the interior cavity. The bottom of the hopper is preferably sloped as shown to facilitate the easy flow of molten metal from the hopper into the inner cavity. The mold 62 is surrounded by an induction heating coil 64, the design and use of which are well known to the art.

Care must be exercised that the bottom closed end of mold 62 is resting on a perfectly horizontal surface within the vacuum furnace throughout the casting operation for reasons which will become obvious. The core, which has been assembled as described above, is lowered and centered into the mold as shown, by suspension. The upper end of the core wire 52 and the upper ends of the guide wires 54 are attached to convenient hangers above and within the furnace. All wires must be kept taut in order that the internal passages (especially the central electron beam passages) be cast in proper lateral relationship to each other. Since the wires are of very small diameter, no problem will be experienced in keeping them taut while at the same time having the core assembly resting firmly against the bottom of the mold. The upper end plug should have sufficient mass to prevent hydrostatic lift of the core assembly by molten metal during the casting operation. As an alternative, the core assembly may be held in firm position by a helical compression spring made of a heat resistant material such as molybdenum.

After the core assembly has been properly positioned within the mold, the hopper is charged and the charge is heated by the induction heater. The melting charge flows into the mold where it completely surrounds the core assembly and fills the mold. After the casting has cooled sufficiently, the suspension wires may be clipped and the cast slow wave structure removed from the mold. The wires, the core elements and the end plugs may be made of mild steel; the mold 62 may be made of stainless steel.

The rough slow wave structure with attached end plugs 60 may now be centered in magnetic chucks, for example, and finished to size on the outside. After this operation has been completed, the end plugs 60 may be machined away to expose the metal core which is now removed by chemical etching. The etching fluid used is dependent on the particular combination of metals used to form the casting and the core elements. A good reference on combinations and etching fluids is "Corrosive Data Survey" 1960 Edition, by G. A. Helson, Shell Development Company.

Figure 6:
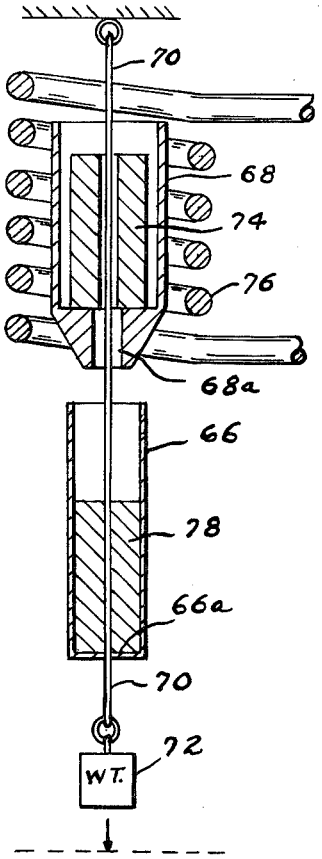
FIG. 6 is an enlarged cross-sectional elevation illustrating the apparatus and method of casting a second form of a slow wave structure.

The raw material charge, from which the slow wave structure is to be cast, may be in any desired form. A "slug" such as slug 74 shown in FIG. 6 is belived preferable because no unmelted particles will be passed into the cavity of the mold. For use in the mold 62 shown in FIG. 5, the slug would take a ring form which slips into the hopper.

The above described slow wave structure may be made with heavy peripheral walls of sufficient thickness to carry integral cooling pasages. The same is true of the two other configurations which will be described below.

Another form of slow wave structure is machined from two castings which were vacuum poured as depicted in FIG. 6. In this form only the electron beam passages are formed by a core, the inner and outer cavity walls being formed by subsequent machining operations. Although the apparatus of FIG. 6 is depicted somewhat different than the apparatus of FIG. 5, the principle is the same, being somewhat modified because of core differences.

Figure 7:
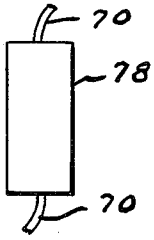
FIG. 7 depicts a typical casting made in the apparatus of FIG. 6, and further showing a portion of the metallic core protruding from each end.

A mold which may be made of quartz, ceramic or metal, as desired, is suspended below a hopper 68 which is open at the upper end and closed at the lower end. A core wire 70 is vertically suspended from a suitable hanger within the furnace and is made taut by a suitable weight 72 at the lower end. The core wire 70 passes through a slip-fit hole 66*a* in the lower closed end of the mold 66 and through a larger hole 68*a* in the closed lower end of hopper 68. The core wire 70 is on the longitudinal axis of the mold. The hopper contains a charge of raw material, as previously described, in the form of a slug 74 which is placed in the hopper before the core wire 70 is put in place. The slug has a hole through which the wire passes. The hopper is surrounded by an induction heating coil 76. As the slug melts, the molten metal flows through hole 68*a* into mold 66 and forms a casting 78 called a "candle". After cooling, the core wire 70 is clipped and the cast "candle" is removed from the mold. FIG. 7 depicts a candle after it is removed from the mold.

Since the core wire 70 was taut during the casting procedure, it will form a true axis which, as will be shown, is to be transformed into the electron beam passage after two candles are machined and assembled.

The first step in the machining operation is to face both ends of the candle, leaving it at any convenient length longer than the final finished length of the slow wave structure to be formed. This step will square both ends of the candle and expose in cross-section the embedded core wire 70. The two faced ends should be parallel with each other and be normal to the core wire.

The second step in the machining operation is to accurately locate and securely support the candle on the table of a precision milling machine. The two opposing ends of the milling machine table are equipped with attached telescopic measuring instruments which are bore-sighted and calibrated so that, when there are identical settings on the instruments, the line of sight will be parallel with the work surface of the milling machine table. A precision milling machine such as manufactured by Deckel of Munich, W. Germany is suitable. The circular cross-section of the core wire which is now exposed at both ends of the candle provides the reference line from which the machining is performed. After the candle has been very accurately oriented and securely clamped, the first milling cut on the upper portion of the candle is made.

Figure 8:
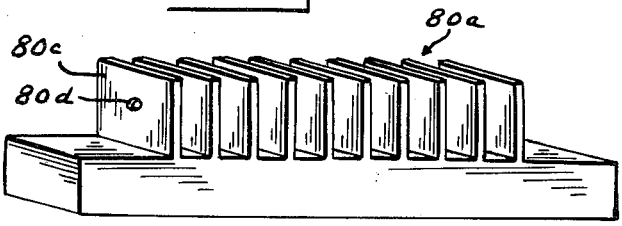
FIG. 8 is a perspective view of one half of the principal portion of a slow wave structure machined from one of the castings shown in FIG. 7.

Specific reference is made to FIG. 8 which depicts one of the two finish machined candles required to form one slow wave structure. For convenience, this machined structure will be referred to as a half wave section 80*a;* or in other words, a candle 78 having a round cross-section is to be machined into a half wave section having a quadrangular cross-section. The half wave section 80*a* has a plurality of comb-like vanes which will form inner cavity walls which will be further explained below.

Within the scope of the present invention, the quadrangular cross-section is not limited to one having 90° angles such as a square or a rectangle. However, as will be shown, it is important for proper assembly that the width of the comb-like vanes 80*c* be made of identical width and that the lateral sides of the structure be on parallel planes. The comb-like vanes may be formed by milling. As depicted, the base of the vanes are square cut; however, other forms may be used, as for example, an arcuate junction as would be formed when the slots are cut on a horizontal milling machine using a circular saw type cutter and a vertical feed on the milling machine.

Figure 10:
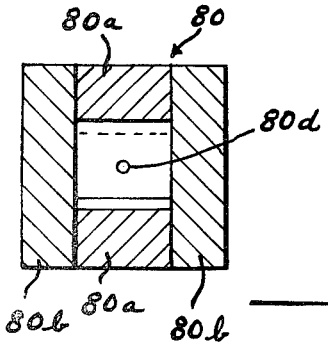
FIG. 10 is a cross-sectional end view along section 10—10 on FIG. 9 showing a square configuration of slow wave structure formed by two half-pieces depicted in FIG. 8 to which two flat side cavity wall pieces are brazed.

Although not limited to such configuration, for purposes of illustration and description, a slow wave structure having a square internal cross-section between the outer cavity walls will be shown and described. As will be described, the external configuration of the slow wave structure may or may not be comparable to the internal configuration. As best shown in FIG. 10, the cross-section of an assembled slow wave structure 80 comprises two half wave sections 80*a* and two side outer cavity wall members 80*b*, the assembly of which will be further described below.

After the candle has been machined to a blank half wave structure having a square or a rectangular cross-section, it becomes necessary to machine the comb-like vanes shown in FIG. 8. These vanes form the inner cavity walls 80*c* which are comparable to the inner cavity walls 40*a* in the slow wave structure depicted in FIG. 3.

The spacing and thickness of the individual cavity walls are very important to the quality of RF circuit performance. In circuits for the higher frequencies, the necessary tolerances which must be maintained are virtually impossible with the measuring techniques used in conventional machine shop practice. It is therefore recommended that laser interferometry methods be used for controlling the width and spacing of the transverse cuts used to produce the inner cavity walls 80*c*. A Hewlett Packard Laser Transducer System Model 5501 is suitable. It is also recommended that the depth of the cuts be properly maintained by using an "air" lubricated milling table such as the Swiss made "Sip" jigbore table. After the inner cavity walls have been machined, the residual plugs of the core wire may be removed by chemical etching, thus leaving the openings which now constitute the electron beam passages.

For purposes of illustration, it is assumed that the slow wave structure to be completed is to have a square cross-section as depicted in FIG. 10. The two half wave structures 80*a* are placed on two end jigs 82 having the portion within the slow wave structure shown in FIG. 9 of square cross-section normal to the longitudinal axis of the slow wave structure. When the two half wave structures are of copper, the jigs may be made of stainless steel, for example. As best disclosed in FIG. 10, the slow wave structure is completed by two side wall members 80*b* which are of length equal to the length of the half wave structures 80*a*.

Figure 9:
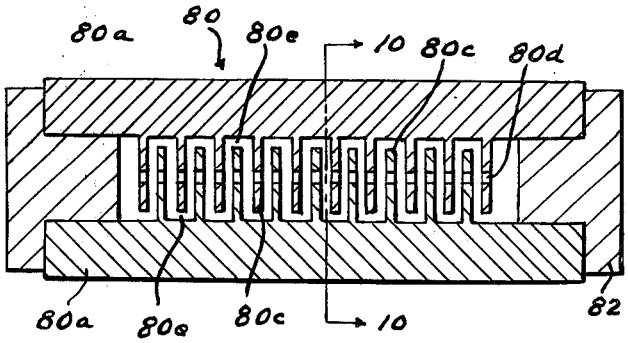
FIG. 9 is a cross-sectional view of a typical slow wave structure having the cavity walls of two halves depicted in FIG. 8 in face-to-face relationship with interdigitating cavity walls in spaced relationship as established by two end jigs.

As best illustrated in FIG. 9, the two half wave structures are assembled with their inner cavity walls 80*c* interdigitating and with their respective electron beam passages on a common longitudinal axis.

The RF passages 80*e* are comparable to the RF passages 46 shown in FIG. 2 and the RF passages 46*a* shown in FIG. 3. It is thus noted that although the passages are of different shape, the RF energy passes through both forms of slow wave structures on comparable meander lines.

When slow wave structure 80 is to be built to the square cross-section shown in FIG. 10, it is noted that the electron beam passage is laterally centered in the inner cavity walls, but is not centered vertically; that is, the distance between the electron beam passage and the base of the cut is equal to the distance between the electron beam passage and the free edge of the inner cavity walls plus the height of the RF passage.

The side wall members 80*b* may be joined to the half wave structures 80*a* by several methods. In this construction there are only two relatively large planes with flat braze joints. The four surfaces must be absolutely flat, a condition which may be achieved by wet lapping prior to assembly. The joining may be done by golf diffusion at relatively low temperature, or by copper diffusion at higher temperature.

Figure 11:
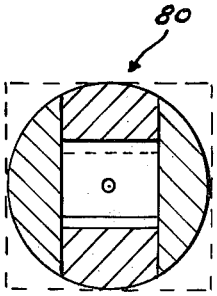
FIG. 11 is a view similar to FIG. 10 in which the square configuration has been machined to a round configuration.

The slow wave structure which has been described is of square cross-section between the outer cavity walls; however, it may as readily be made of rectangular cross-section or other parallelogram type of configuration. If desired, a slow wave structure of external square cross-section may easily be machined to have a round external cross-section as depicted in FIG. 11. The external portion of the end plugs 82 shown in FIG. 9 may be made round for holding in suitable collets, or they may be provided with lathe centers (not shown). After all brazing and/or machining operations have been completed, the jigs are removed and the slow wave structure is further machined at the ends to finished length.

Specific reference is now made to FIG. 12 which depicts a third form of the present invention. The traveling wave device 84 operates on the same general electronic principles as the traveling wave device depicted in FIG. 1; however it requires some configuration displacement because the electron beam passage is outside the slow wave structure.

The traveling wave device 84 has an elongated body member 86 having two end caps 86*a* which are brazed to provide a vacuum tight container for the internal elements of the device.

The electron gun at one end of the body member has the same principal elements as the gun shown in FIG. 1 and comprises a cathode 88, a focusing electrode 90, an anode 92, and the required lead wires for electrical input. At one end of the body member, a collector 94 is dielectrically supported in end cap 86*a* for collecting and dissipating the spent electrons. As further indicated, the present structure also has a sole 96 which functions for a purpose and in a manner well known to the art. The sole 96 is dielectrically supported within the body member 86 and is electrically energized through a lead 98 extending through the body member.

The slow wave structure 100 is dielectrically supported within body member 86 as indicated, and is connected to a RF imput line 102 and a RF output line 104. The traveling wave device is encompassed by electromagnetic means for producing a magnetic field 106 for directing the electron beam from the gun to the collector in the manner well known to the art.

Specific reference is now made to FIG. 13 which is a perspective view of a portion of the slow wave structure 100 with a portion of the split outer wall broken away to show construction details. The bottom outer wall 100*a*, the two side outer walls 100*b* and the two end outer walls 100*c* are to be cast integral with the inner cavity walls 100*d*. It is noted that the inner cavity walls are staggered to provide the same type meander line as the slow wave structure depicted in FIG. 9; the only difference being that, as depicted, the meander line in FIG. 13 is horizontal and that in FIG. 9 is shown to be vertical. Their electronic functions are the same. The cast structure may be described as a box with an open top and containing a plurality of staggered inner walls joined to the bottom wall and alternating side walls. The outer cavity wall 100*e* is "split" with cutouts which follow the meander lines formed by the inner cavity walls. As depicted, the splits are smaller than the passages between the inner cavity walls and also overlap the cavity walls, as well as extending inward from the outer walls or sides of the cast "box" structure. The splits in this type of slow wave structure have the same functions as the electron beam passages in the forms of slow wave structures previously described; i.e., they provide interaction passages between the RF energy and the electron beam. The brazing technique for joining the split outer cavity wall is the same technique previously described for the slow wave structure shown in FIGS. 9 and 10.

FIG. 14 is an upward looking perspective of the core structure used to form the casting depicted in FIG. 13. The core assembly 108 may be made of the same material as the other cores and is split into two halves along the longitudinal axis as indicated for convenience in machining the staggered slots 108*a* which form the inner cavity walls 100*d*. The portion of the core containing the slots 108*a* forms the inside of the outer cavity walls 100*a*, 100*b* and 100*c*. The upper larger portion 108*b* of the core extends out from the perimeter containing the slots, and contains a plurality of lateral drilled holes for receiving a plurality of bolts 110 for holding the core halves together. The lower face of the upper portion 108*b* of the core assembly has four downward extending legs 108*c* which extend a predetermined distance below the lower face of the core element carrying the slots.

To form the casting, the core assembly is placed into a suitable mold of rectangular shape and open at the top, and further having a flat bottom against which legs 108*c* rest and support the core in the same manner that legs support a table. The distance between the bottom of the core and the legs establishes the thickness of the bottom outer wall 100*a* of the rough slow wave structure 100. The length, width and depth of the mold are sufficient to permit the entire core assembly (including the protruding bolt heads and nuts) to enter the cavity of the mold. The casting is to be vacuum cast by using an apparatus and techniques previously described, for which reason they will not be repeated.

After the casting has cooled sufficiently, it is removed from the mold and machined to size. It is noted that the entire metallic core can be disposed by machining operations with the exception of the portion between the inner cavity walls, which is disposed by chemical etching.

A variation of the split folded wave guide slow wave structure described above is to form the end outer walls 100*c* of the same flat material used to form the split outer cavity wall 100*e*, and to join them into position on the casting by the same techniques used to join the split outer cavity wall.

It is to be understood that the embodiment of the present invention as shown and described is to be regarded merely as illustrative, and that the invention is susceptible to variations, modifications and changes, without regard to construction methods, within the scope of the appended claims.

I claim:

1. A traveling wave device comprising:

(a) a body member;

(b) a metallic slow wave structure within the midsection of said body member, said slow wave structure including at least one casting formed in a mold having a chemically disposable core which is subsequently removed to leave at least a portion of the electrical passages through said slow wave structure;

(c) RF energy means joined to said slow wave structure for passing RF energy through said slow wave structure;

(d) means within said body member spaced from the first end of said slow wave structure for generating an electron beam interacting with the RF energy flowing through said slow wave structure;

(e) magnetic means encompassing said body member for producing a magnetic field for guiding said electron beam; and, (f) collector means within said body member spaced from the second end of said slow wave structure for collecting the spent electron beam.

2. A traveling wave device comprising:

(a) a body member;

(b) a metallic integrally cast slow wave structure within the midsection of said body member, said slow wave structure being formed in a mold having an elongated chemically disposable core which is subsequently removed to leave a plurality of inner and outer cavity walls and having a passage which is radially displaced from the longitudinal axis through each inner cavity wall for the flow of RF energy through said slow wave structure, and further leaving a passage on the longitudinal axis through each inner cavity wall for the flow of an electron beam through said slow wave structure;

(c) RF energy means joined to said slow wave structure for passing RF energy through said slow wave structure;

(d) means within said body member spaced from the first end of said slow wave structure for generating an electron beam interacting with the RF energy flowing through said slow wave structure;

(e) magnetic means encompassing said body member for producing a magnetic field for guiding said electron beam; and, (f) collector means within said body member spaced from the second end of said slow wave structure for collecting the spent electron beam.

3. A slow wave structure for use in a traveling wave device or the like utilizing RF energy and an electron beam, said slow wave structure comprising: a metallic integrally cast elongated structure being formed in a mold having an elongated chemically disposable core which is subsequently removed to leave a plurality of inner and outer cavity walls and having a passage which is radially displaced from the longitudinal axis through each inner cavity wall for the flow of RF energy through said slow wave structure, and further leaving a passage on the longitudinal axis through each inner cavity wall for the flow of an electron beam through said slow wave structure.

4. A traveling wave device comprising:

(a) a body member;

(b) a metallic slow wave structure within the midsection of said body member, said slow wave structure having longitudinally spaced transverse inner cavity walls machined on castings and arranged to provide meander line passages for the flow of RF energy through said slow wave structure, said castings being formed in a mold having an elongated chemically disposable core which is subsequently removed to leave a passage on the longitudinal axis through each inner cavity wall for the flow of an electron beam through said slow wave structure;

(c) RF energy means joined to said slow wave structure for passing RF energy through said slow wave structure;

(d) means within said body member spaced from the first end of said slow wave structure for generating an electron beam interacting with the RF energy flowing through said slow wave structure;

(e) magnetic means encompassing said body member for producing a magnetic field for guiding said electron beam; and, (f) collector means within said body member spaced from the second end of said slow wave structure for collecting the spent electron beam.

5. A slow wave structure for use in a traveling wave device or the like utilizing RF energy and an electron beam, said slow wave structure comprising: a first and a second elongated elongated half section produced from a casting formed in a mold having an elongated chemically disposable core which is subsequently removed to provide an electron beam passage in said slow wave structure, said first and second half sections having an elongated outer cavity wall portion and a plurality of machined spaced inner cavity walls normal to and transverse to the longitudinal outer cavity wall and having an electron beam passage through each machined inner cavity wall; said first and second half sections being in face-to-face relationship with all electron beam passages in the two half sections being on a common longitudinal axis to provide passages for an electron beam passing through said slow wave structure and with the inner cavity walls on the first half section interdigitating with the inner cavity walls of the second half section in spaced relationship providing passages between the inner cavity walls and connecting passages between the free end of the inner cavity walls on one half section and the outer cavity walls of the other half section and with the sides of the inner cavity walls on one of said half sections on parallel planes with the sides of the inner cavity walls on the other half section to provide meander line passages for RF energy passing through said slow wave structure; and two elongated side outer wall members each of which is joined to one elongated open side of the positioned half sections and forming a portion of the outer cavity walls, the elongated outer cavity wall portions on said first and second half sections and said side outer wall members forming the complete outer cavity walls of said slow wave structure.

6. A traveling wave device comprising:

(a) a body member;

(b) a metallic slow wave structure within the midsection of said body member, said slow wave structure having a casting formed in a mold having a chemically disposable core which is subsequently removed to leave a bottom outer cavity wall, adjacent integral side outer cavity walls and a plurality of longitudinally spaced transverse inner cavity walls each of which is integrally cast with the bottom outer cavity wall and alternately cast with one of the side outer cavity walls providing meander line passages for RF energy passing through said slow wave structure; and a fourth outer cavity wall brazed to the free edges of the side outer cavity walls, said fourth outer cavity wall containing splits superimposed over the RF meander line passages formed by the inner cavity walls and the side outer cavity walls;

(c) RF energy means joined to said slow wave structure for passing RF energy through said slow wave structure;

(d) means within said body member and spaced from said slow wave structure for generating and guiding an electron beam longitudinally parallel with and adjacent to the splits in the fourth outer cavity wall of said slow wave structure, the RF energy flowing through said slow wave structure interacting with the adjacent electron beam through the splits in said slow wave structure;

(e) magnetic means encompassing said body member for producing a magnetic field for guiding said electron beam; and, (f) collector means within said body member and spaced for collecting the spent electron beam.

7. A metallic slow wave structure for use in a traveling wave device or the like utilizing RF energy and an electron beam, said slow wave structure comprising: a casting formed in a mold having a chemically disposable core which is subsequently removed to leave a bottom outer cavity wall, adjacent integral side outer cavity walls and a plurality of longitudinally spaced transverse inner cavity walls each of which is integrally cast with the bottom outer cavity wall and alternately cast with one of the side outer cavity walls providing meander line passages for RF energy passing through said slow wave structure; and further having integrally cast end walls to form an open box-type structure; and a fourth outer cavity wall brazed to the upper edges of the end walls, the upper edges of the side outer cavity walls and the upper edges of the inner cavity walls, said fourth outer cavity wall containing splits superimposed over and following the meander line passages.

8. A metallic slow wave structure for use in a traveling wave device or the like utilizing RF energy and an electron beam, said slow wave structure comprising: a casting formed in a mold having a chemically disposable core which is subsequently removed to leave a U-shaped member having a bottom outer cavity wall and two adjacent side outer cavity walls, a plurality of transverse longitudinally spaced inner cavity walls integrally cast with the bottom outer cavity wall and alternately cast with the adjacent side outer cavity walls forming meander line passages for RF energy passing through said slow wave structure; end members brazed to the open ends of said U-shaped member; and a fourth outer cavity wall brazed to the upper edges of the end members, the upper edges of the side outer cavity walls and the upper edges of the inner cavity walls, said fourth outer cavity wall containing splits superimposed over and following the meander line passages.

* * * * *

UNITED STATES PATENT AND TRADEMARK OFFICE

CERTIFICATE OF CORRECTION

PATENT NO. : 4,129,803

DATED : December 12, 1978

INVENTOR(S) : Walter Friz

It is certified that error appears in the above-identified patent and that said Letters Patent are hereby corrected as shown below:

Delete: [73] Assignee: Louis E. Hay, Dayton, Ohio and substitute the following corrected to read:

[73] Assignee: Louis E. Hay, Dayton, Ohio, a part interest.

In column 8, line 57, change "golf" to -- gold -- .

Signed and Sealed this

*Fourth* Day of *November 1980*

[SEAL]

*Attest:*

SIDNEY A. DIAMOND

*Attesting Officer*

*Commissioner of Patents and Trademarks*